US009044931B2

(12) United States Patent
LeFevre et al.

(10) Patent No.: US 9,044,931 B2
(45) Date of Patent: Jun. 2, 2015

(54) APPARATUS AND METHOD FOR APPLYING A RELEASE AGENT TO A SUBSTRATE HAVING A PRINT IMAGE

(75) Inventors: Jason LeFevre, Penfield, NY (US); James Michael Chappell, Webster, NY (US); Paul McConville, Webster, NY (US); James Edward Williams, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 146 days.

(21) Appl. No.: 13/517,561

(22) Filed: Jun. 13, 2012

(65) Prior Publication Data

US 2013/0333583 A1 Dec. 19, 2013

(51) Int. Cl.
*B41F 35/00* (2006.01)
*B41F 23/06* (2006.01)
*B41F 23/00* (2006.01)

(52) U.S. Cl.
CPC ..... *B41F 23/06* (2013.01); *B41F 23/00* (2013.01)

(58) Field of Classification Search
USPC ..... 101/424.2
See application file for complete search history.

(56) References Cited

U.S. PATENT DOCUMENTS 3,705,451 A * 12/1972 Dahlgren ..... 29/895.32
4,009,657 A * 3/1977 Bonanno et al. ..... 101/157
4,026,210 A * 5/1977 Merzagora ..... 101/350.5
4,290,363 A * 9/1981 Kobler ..... 101/351.1
4,425,848 A * 1/1984 Bell ..... 101/350.5
4,685,414 A * 8/1987 DiRico ..... 118/46
4,836,129 A * 6/1989 Dahlgren ..... 118/46
5,178,678 A * 1/1993 Koehler et al. ..... 118/46
5,983,058 A * 11/1999 Yamasaki et al. ..... 399/237
6,002,894 A * 12/1999 De Niel et al. ..... 399/69
6,299,685 B1 * 10/2001 Siler et al. ..... 118/58
6,360,072 B1 * 3/2002 Costrop et al. ..... 399/325
7,249,559 B2 * 7/2007 McNeil ..... 101/483
7,979,014 B2 * 7/2011 Achten et al. ..... 399/327
8,073,374 B2 * 12/2011 Halfyard et al. ..... 399/327
2007/0098469 A1 * 5/2007 Yoshino et al. ..... 399/340
2010/0053239 A1 * 3/2010 Furukawa ..... 347/6

* cited by examiner

*Primary Examiner* — Anthony Nguyen

(74) *Attorney, Agent, or Firm* — Ronald E. Prass, Jr.; Prass LLP

(57) ABSTRACT

An approach is provided for applying a release agent to a substrate having a first surface and a second surface. The approach involves causing, at least in part, a release agent supply device to supply release agent to a release agent applicator. The approach also involves causing, at least in part, a release agent metering device configured to control an amount of release agent applied to a roller configured to apply release agent to the first surface of the substrate. The roller is configured to accommodate the substrate under a tension over at least a portion of a circumference of the roller such that a pressure is exerted between the roller and the first surface of the substrate.

18 Claims, 7 Drawing Sheets

APPARATUS AND METHOD FOR APPLYING A RELEASE AGENT TO A SUBSTRATE HAVING A PRINT IMAGE

FIELD OF DISCLOSURE

The disclosure relates to an apparatus and method for applying a release agent useful in printing to a substrate. The release agent is applied to prevent offset of one or more inks related to an image from a substrate to one or more portions of print processing and/or finishing equipment.

BACKGROUND

During a manufacturing process of printed material, ink printed onto a substrate often offsets from the substrate to various parts of printing apparatuses and/or finishing equipment such as, but not limited to, rollers, winders, unwinders, die cutters, buffers, stackers, back sides of rolled and/or stacked printed substrates, etc.

Various conventional printing apparatuses prevent ink offset from a printed substrate to various parts of the printing apparatus within themselves during or before a print process by optimizing a number of different options that include controlling: 1) ink/substrate and/or drum/roller surface temperature, 2) drum/roller surface finish, 3) absence of relative motion between ink/substrate and drum/roller surfaces and 4) application of a release agent.

In conventional printed product manufacturing, a substrate, having been printed, is often made ready for finishing by rolling or stacking the substrate. Some of the release agent applied within a conventional printing apparatus may remain on the substrate after the printing process is complete as a side effect of the printing process. But, there is often not enough release agent remaining on the substrate to prevent ink offset from the printed substrate to various parts of the printing apparatus downstream of the one or more positions within the printing apparatus where the print process occurs, or of finishing equipment positioned downstream of the printing apparatus in the print product manufacturing process.

SUMMARY

Therefore, there is a need for an approach to apply a release agent to a substrate to prevent ink offset from the substrate to one or more portions of print processing and/or finishing equipment.

According to one embodiment, an apparatus useful in printing comprises a release agent supply device configured to supply release agent to a release agent applicator. The apparatus also comprises a release agent metering device configured to control an amount of release agent applied to a roller configured to apply release agent to a first surface of a substrate having a first surface and a second surface. The roller is configured to accommodate the substrate under a tension over at least a portion of a circumference of the roller such that a pressure is exerted between the roller and the first surface of the substrate.

According to another embodiment, a method for applying a release agent to a substrate having a first surface and a second surface comprises causing, at least in part, a release agent supply device to supply release agent to a release agent applicator. The method also comprises causing, at least in part, a release agent metering device configured to control an amount of release agent applied to a roller configured to apply release agent to the first surface of the substrate. The roller is configured to accommodate the substrate under a tension over at least a portion of a circumference of the roller such that a pressure is exerted between the roller and the first surface of the substrate.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments are illustrated by way of example, and not by way of limitation, in the figures of the accompanying drawings.

DETAILED DESCRIPTION

Figure 1:
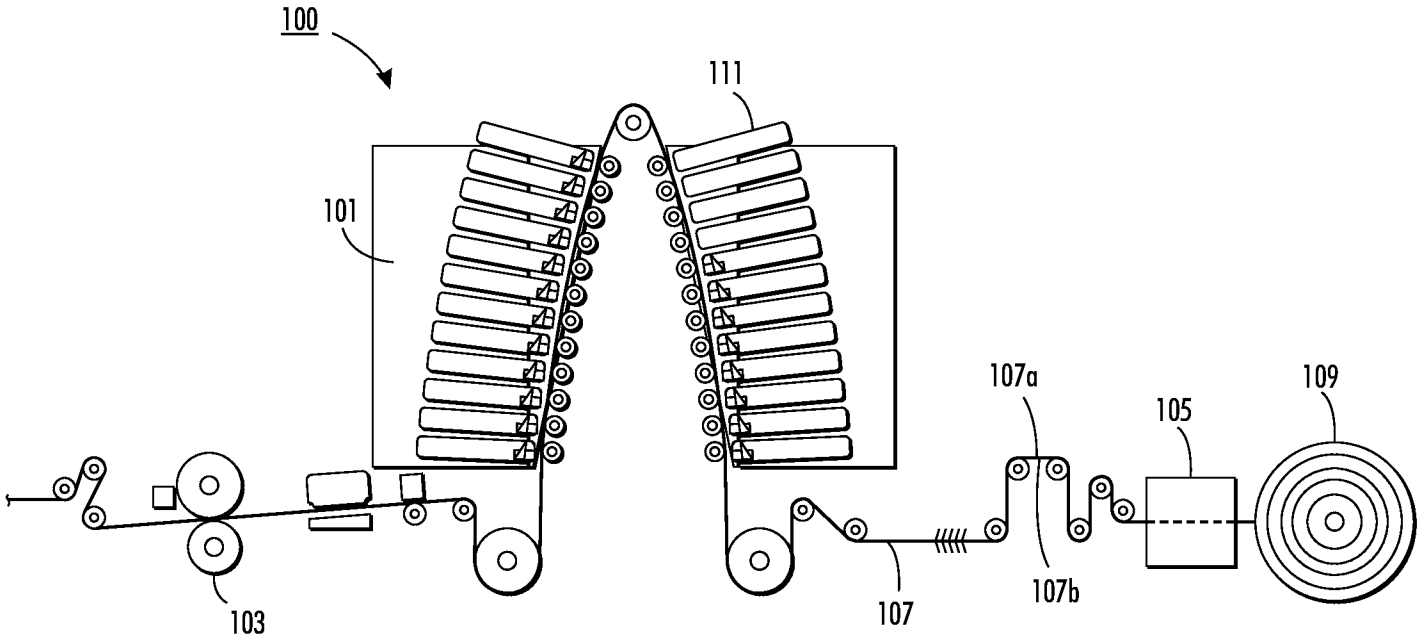
FIG. 1 is a diagram of a system capable of applying a release agent to a substrate to prevent ink offset from the substrate to one or more portions of print processing and/or finishing equipment, according to one embodiment.

Examples of a method, apparatus, and computer program for applying a release agent to a substrate to prevent ink offset from the substrate to one or more portions of print processing and/or finishing equipment are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures devices are shown in block diagram form in order to avoid unnecessarily obscuring the embodiments.

As used herein, the term release agent refers to any type of oil, silicone-based product, silicone mix product, water mixture, water, liquid, powder, etc. that may be applied to a printed substrate to prevent ink offset from the substrate to any printing and/or finishing equipment. For example, a type of oil that can be used to achieve the desired results in preventing ink offset may be Silicon based oils blended w/small amounts of amine (e.g. 0.5% amine), or oils described as a polydimethylsiloxane+polydimethylsiloxane with aminoalkyl groups and has a kinematic viscosity in the 50 cS to 100 cS range. More specifically, the kinematic viscosity may be in a range of 70 cS to 80 cS.

During a manufacturing process of printed material, ink printed onto a substrate often offsets from the substrate to various parts of printing apparatuses and/or finishing equipment such as, but not limited to, rollers, winders, unwinders, die cutters, buffers, stackers, back sides of rolled and/or stacked printed substrates, etc.

Various conventional printing apparatuses prevent ink offset from a printed substrate to various parts of the printing apparatus within themselves during or after a printing process by optimizing a number of different options that include controlling: 1) ink/substrate and/or drum/roller surface temperature, 2) drum/roller surface finish, 3) absence of relative motion between ink/substrate and drum/roller surfaces and 4) application of a release agent.

In conventional printed product manufacturing, a substrate, having been printed, is often made ready for finishing by rolling or stacking the substrate. Some residual of the release agent applied within a conventional printing apparatus may remain on the substrate after the printing process is complete as a side effect of the printing process. But, there is often not enough release agent remaining on the substrate to prevent ink offset from the printed substrate to various parts of the printing apparatus downstream of the printing process and/or finishing equipment.

A large portion of the printing industry (about 80% of the continuous feed industry, for example) prints product onto a substrate roll-to-roll on the printing apparatus. That is, the substrate starts as a roll of, for example, paper, plastic, metal, carbon fiber, etc., whether initially printed or blank, the roll as it is fed into a print engine, and re-wound at the end of a print process conducted by the print engine. The roll is then often transferred at some later point in time to off-line finishing equipment such as a sheeter, for example. Some print engines, as discussed above, may be configured to apply a release agent to the substrate as it is printed to prevent ink offset to parts of the print engine. During a printing process, some of this release agent remains on the substrate as it is wound as a side effect. This remaining release agent sometimes protects printing apparatus parts and/or off-line finishing equipment from ink offset, but, there is often not enough release agent remaining on the substrate to prevent downstream ink offset.

For example, in the case of off-line finishing, when the substrate is wound up on a large roll, the residual release agent applied to the substrate by the print engine is allowed to migrate from the top surface of the substrate on either side into the center of the thickness of the substrate and/or disperse by other means such as if the roll is stood up on its side for storage the release agent may migrate to a bottom side that the roll rests upon in storage, etc. This may happen instantaneously, or after a roll is allowed to sit for some time before being processed downstream of the print engine by any finishing equipment. A similar issue of migration often arises if the substrate is sheeted and stacked rather than rolled. It is this migration that is problematic for off-line finishing, even if an appropriate amount of residual release agent remains on the substrate after printing because it reduces the effectiveness of the "protective barrier" of the residual release agent and compromises the resistance to ink offset in the finishing equipment.

Conventional off-line finishing equipment often do not have release agent application devices like some print engines and are often made by different manufacturers, and/or separately located from a print engine, and/or separately controlled. As such, it is difficult to control the 1) ink/substrate and/or drum/roller surface temperature, 2) drum/roller surface finish, and 3) absence of relative motion between ink/substrate and drum/roller surfaces in the finishing equipment to help prevent ink offset like in a print engine. Also, some print engines may not have such controllable features, or even be configured to apply a release agent to printed substrates to even result in the residual release agent being present on the substrate.

To address this problem, a system 100 of FIG. 1 introduces the capability to apply a release agent to a substrate to prevent ink offset from the substrate to one or more portions of print processing and/or finishing equipment. As shown in FIG. 1, the system 100 comprises a print system 101, a print system release agent spreader module 103 and a release agent application apparatus 105 configured to treat a substrate 107 with a release agent at least prior to entering any finishing equipment.

In this embodiment, the release agent application apparatus 105 is positioned at a location before the substrate 107 is wound onto a roll 109 and downstream of any printing process that the print system 101 may perform to apply an ink to form an image onto the substrate 107. For example, the print system 101 may apply an image to the substrate 107 by way of any means such as offset printing or inkjet printing, for example, using print stations 111. According to various embodiments, one or more release agent application apparatuses 105 may be positioned internal to the print system 101 to apply release agent to the substrate 107 at any point after a printing process performed by the print system 101. For example, a release agent application apparatus 105 may be positioned to apply a release agent between color applications and/or between various stages of applying ink to form an image on the substrate 107 if, for example, the print system 101 has more than one print station 111.

In the example illustrated in FIG. 1, the release agent application apparatus 105 adds additional release agent to any release agent that may be applied by the print system release agent spreader module 103, or applies release agent to the substrate 107 for the first time if the print system 101 either did not apply a release agent, or is not configured to apply a release agent at a position downstream of any printing process performed by the print system 101 before the substrate is wound to create roll 109. In alternative embodiments, the substrate 107 may be provided to the print system 101 as pre-cut sheets rather than as a roll which would result in the sheeted substrate being stacked at a backend of the print system 101 rather than being wound. Or, in another embodiment, the print system 101 may be configured to receive a rolled substrate and cut the substrate 107 into sheets for stacking after completion of a printing process performed by the print system 101 to apply an image to the substrate.

As discussed above, one problem with rolling or stacking printed substrate relates to the state of the printed substrate as it enters off-line finishing equipment after some period of time that the printed roll has sat idle following the printing process on the print system 101. In the case of an in-line finishing operation the print system residual release agent acts as a protective barrier, if enough remains on the substrate 107, to prevent ink offset within the printing system 101 but also when that same image enters finishing equipment if sufficient residual release agent remains on the substrate after the printing process is complete.

But, an amount of the residual release agent present on the substrate 107 is often not reliable and ink offset still occurs. Accordingly, at least the release agent application apparatus 105 is positioned after the entire print process is complete as an example and before the substrate is prepared for finishing by way of forming the roll 109, or stacking sheets if the substrate is sheeted, for example. In other embodiments that will be discussed in more detail below, one or more release agent application apparatuses 105 may also be positioned on or between any piece of finishing equipment that may be retrofitted with the release agent application apparatus 105.

Accordingly, any release agent application apparatus 105 controls the state of the substrate going into the printing and/or finishing equipment (or process) that it may be positioned before in the print product manufacturing process by applying a release agent to a printed substrate to protect the printing and/or finishing equipment from ink offset. According to various embodiments, the release agent application apparatus 105 may be positioned to protect nearly any configuration of finishing equipment by retrofitting the release agent application apparatus 105 to fit the finishing equipment or retrofitting the finishing equipment to accommodate the release agent application apparatus 105, or by using a free-standing release agent application apparatus 105 to condition a substrate with release agent and protect any finishing equipment from ink offset. For example, whether free-standing, or retrofitted, the release agent application apparatus 105 may be attached to, or placed in front of, the in-feed side of off-line finishing equipment and configured to apply a layer of release agent to a first side 107*a*, a second side 107*b*, or both sides 107*a*, 107*b* of the substrate 107, in this example.

The fresh release agent applied to the substrate 107 immediately before process performed by any piece of finishing equipment will protect the image from ink offset to any surfaces within the finishing equipment which contact the inked substrate 107. Alternatively, or in addition to placing the release agent application apparatus 105 at the in-feed side of a piece of finishing equipment, the release agent application apparatus 105 may be positioned at the out-feed side of a piece of finishing equipment so that a next piece of finishing equipment may be protected from ink offset.

According to various embodiments, the release agent application apparatus 105 may be configured to apply a release agent to one side of a substrate 107 in the case of a simplex printed substrate 107. In simplex printing, there would only be a need to apply release agent to the printed side of the printed substrate. In other embodiments, the release agent application apparatus 105 may be configured to selectively apply release agent to two sides of a printed substrate in a case of duplex printing which would print an image on two sides of the substrate 107. If configured for duplex printing, a single release agent application apparatus 105 may be configured to treat both the first side 107*a* and the second side 107*b* of the substrate, or more than one release agent application apparatus 105 may be used to apply the release agent to the substrate 107. For example, because there would be a need to apply release agent to both the first side 107*a* and second side 107*b* of the printed substrate 107, a first release agent application apparatus 105 may be provided to treat the first side 107*a*, and a second release agent application apparatus 105 may be inverted and provided to treat the second side 107*b* of the substrate 107 with release agent.

Evidence suggests that the ink offset performance varies greatly depending if the substrate 107 has or has not been freshly treated with release agent. A freshly treated image that is immediately fed into an in-line finishing process is far more robust to ink offset than an image that has been treated at a prior time, allowed to sit (for some time greater than one hour, or even a few minutes, for example), and then fed back into an off-line finishing process. Accordingly, when residual release agent applied by the print system release agent spreader module 103 carryout is low (i.e., the residual amount of release agent being less than 2 mg/A4 paper size), and the substrate is allowed to sit for a period of time, greater than a day, for example, it is typical for inked areas of the substrate 107 to cause a severe amount of ink offset to, for example, a stationary baffle in various types of finishing equipment. But, when the residual release agent applied by the print system release agent spreader module 103 oil carryout is high (i.e., the residual amount of release agent being about 7-8 mg/A4 paper size) there is typically no evidence of ink offset onto finishing equipment over long runs of printing images onto the substrate 107 and finishing the printed product by way of processing the printed substrate 107 through various finishing equipment.

While a print system may be configured to apply a release agent for its own print processing, the residual release agent is an unreliable source of ink offset protection. Additionally, though it may be feasible to cause high oil carryout by increasing the output of release agent applied to the substrate by the print system release agent spreader module 103 to result in higher residual release agent carryout, this would require over applying the release agent to the substrate 107 inside the print system 101 in hopes of causing an overabundance of release agent to remain on the substrate 107 through the print process performed by the print system 101, and then remain on the substrate 107 after the print process is complete. However, such practice is impractical for many reasons. For example, flooding the substrate 107 with release agent by the print system release agent spreader module 103 is expensive because it wastes release agent by applying an overabundance of release agent. Additionally, applying too much release agent during or before the print process may affect image quality because the release agent may saturate the substrate 107, or migrate unevenly across the substrate 107 during the print process which would affect ink/image adhesion and/or absorption.

Therefore, to avoid waste, make applying a release agent a greener step in a print product manufacturing process, and to avoid image quality issues, the release agent application apparatus 105 is configured to apply release agent to the substrate 107 at an opportune time in the print product manufacturing process. That is, before the printed substrate 107 enters any selected piece printing equipment downstream of a printing process that may need protection from ink offset or finishing equipment whether it be a winder, die cutter, buffer, stacker, gluer, etc. or any combination thereof depending where one or more release agent application apparatuses 105 are positioned throughout the print product manufacturing process in relation to any piece of printing and/or finishing equipment.

Additionally, to avoid one or more of waste and oversaturation, the release agent application apparatus 105 is configured to selectively apply one or more controlled amounts of release agent to the substrate 107. For example, in one embodiment, the release agent application apparatus 105 is configured to selectively apply the release agent at an a rate that may be fixed or adjustable depending on the configuration of the release agent application apparatus of 2 mg/A4 paper size to 12 mg/A4 paper size. In another embodiment, the release agent application apparatus 105 is configured to selectively apply the release agent at an a rate that may be fixed or adjustable depending on the configuration of the release agent application apparatus of 4 mg/A4 paper size to 10 mg/A4 paper size. In another embodiment, the release agent application apparatus 105 is configured to selectively apply the release agent at an a rate that may be fixed or adjustable depending on the configuration of the release agent application apparatus of 7 mg/A4 paper size to 8 mg/A4 paper size.

By applying a selected controlled amount of release agent, the release agent application apparatus 105 applies an optimal amount of release agent to the substrate 107 to prevent ink offset to various printing and/or finishing equipment without flooding the substrate with release agent and relying on a residual amount to remain. Additionally, by applying the release agent at the opportune time, such as just as the substrate is about to enter a piece of finishing equipment, any migration effects caused when the release agent moves around the substrate 107 over time are mitigated.

According to various embodiments, the release agent application apparatus 105 may be configured to determine a position of an image on the substrate 107 by way of various sensors or user control to selectively apply the release agent only to portions of the substrate upon which the image is detected. For example, the release agent application apparatus 105 may be configured to determine whether an image is present on any side of a substrate 107. If, for example, the substrate 107 has two sides, the release agent application apparatus 105 may determine that an image is present on a first side 107*a* and not on a second side 107*b* (or the second side 107*b* and not the first side 107*a*), and therefore be caused to only apply release agent to the first side 107*a* (or the second side 107*b* if that side has the image) of the substrate 107 having this image. The release agent application apparatus 105 may be caused to apply a release agent to only the portion, or portions, of the side 107*a*/107*b* of the substrate 107 having the detected image, or the release agent application apparatus 105 may be selectively caused to apply release agent to an entire side of the substrate 107 having the detected image, for example. The portions of the substrate 107 upon which the release agent is applied on account of the determined image may be limited to tracing of the image itself, portions slightly smaller than the image to avoid overuse of release agent, or portions slightly larger than the image but smaller in area that an entire surface of the substrate 107 upon which the image is applied. For example, the portion may be a geometrical shape such as a square within which the image lies or a sector of the surface of the substrate 107 upon which the image is applied, or the portion may be a traced shape of the image fully coating the image and having a boarder around the image formed from release agent.

Alternatively, the release agent application apparatus 105 may be caused to apply release agent to both sides 107*a*/107*b* of the substrate 107 regardless of whether an image is detected on both sides 107*a*/107*b* of the substrate 107. Or, if the substrate 107 is subjected to duplex printing, i.e. printing an image on both the first side and the second side of the substrate 107, the release agent application apparatus 105 may be configured either alone, or in conjunction with one or more other release agent application apparatuses 105, to selectively apply release agent to one or more of both the first side 107*a* and the second side 107*b* of the substrate 107, one or more of selected portions of both the first side and the second side of the substrate 107, one or more of the entire side of both the first side 107*a* and the second side 107*b* of the substrate 107, or any combination thereof. It should be noted that while the above example refers to a substrate 107 having a first side 107*a* and a second side 107*b*, it should be understood that the substrate 107 may have any number of sides upon which an image may be printed, and any number of release agent application apparatus 105 may be used to apply release agent to any number of sides upon which an image may be printed, detected, or even if a certain side of the substrate 107 is unprinted.

According to various embodiments, as discussed above and illustrated in more detail below in FIG. 3, the release agent application apparatus 105 may, for example, include a release agent supply device, a roller such as a hard donor roll which may also be configured as a belt, and a metering device that supplies a metered amount of release agent to the roller.

In one or more embodiments, the roller may be configured to accommodate the substrate 107 whether it be sheeted or in web form such that the substrate 107 is under a tension over at least a portion of a circumference of the roller. For example, the substrate 107 may be in contact with the roller for about 180° of its circumference, or any amount more or less than that such that the release agent may be applied and spread over the surface of the substrate 107 that is in contact with the roller when the substrate 107 is under the tension. The tension that the substrate 107 is under, for instance, may cause a pressure to be exerted between the roller and the surface of the substrate 107 that is in contact with the roller.

According to various embodiments, the circumference of the donor roll has a direct relationship with the speed at which the substrate 107 may be advanced through the release agent application apparatus 105 to cause sufficient release agent application. If, for example, the donor roll has a 12 inch circumference, and the substrate 107 wraps around the donor roll for 180° of its circumference, the substrate 107 contacts 6 inches of the donor roll's circumference for release agent application. In such a configuration, the substrate 107 may be advanced through the release agent application apparatus at a rate of about 500 fpm. Alternatively, if the donor roll has a greater circumference, the amount that the substrate wraps around the donor roll may be decreased, or the rate at which the substrate 107 is advanced through the release agent application apparatus 105 may be increased. The same trend occurs if the circumference of the donor roll decreases, the rate at which the substrate 107 is advanced through the release agent application apparatus may be decreased and the amount that the substrate 107 wraps around the roller may increase so that the substrate 107 is in contact with the roller for a sufficient period of time to apply the release agent. The donor roll may also be used to change an overall direction of movement of the substrate 107, and accordingly may be in contact with the substrate 107 for greater or lesser amounts than those suggested above.

In one or more embodiments, the release agent supply device may include any of a drip tube having one or more holes populated along a length of the drip tube so that release agent may be supplied to a release agent applicator. If the release agent supply device is a drip tube, the drip tube may comprise a copper, polymer, aluminum, and stainless steel, for example. In alternative embodiments, the release agent supply device may be a series of one or more sprayers that are configured to supply release agent to the release agent applicator.

The release agent applicator, for example, may be a soft or hard roller that applies release agent to the hard donor roll. Alternatively, the release agent supply device may be a series of sprayers or jets that either apply release agent to the donor roll.

Once the release agent applicator applies release agent to the donor roll, the release agent metering device is configured to control an amount of release agent that is applied by the donor roll to the substrate 107 when the substrate is in contact with the circumference of the donor roll under tension. For example, the release agent metering device may be a blade that allows a predetermined amount of release agent to be applied to the substrate 107.

According to various embodiments, the donor roll may be any of an aluminum drum coated w/an anodize (e.g. "Hardcoat" or "Hardlube") intended to deliver desired surface roughness and durability, ceramic, other metal, plastic, carbon fiber, etc.

According to various embodiments, if the release agent metering device is a blade such as that discussed above, the blade may be constructed of any type of steel coated w/polyurethane rubber or any other coating of any material of a given thickness (e.g. 2 mm, 7 mm in free length, etc.) to enable conformability, or any solid polyurethane, polymer, composite, other metal that is softer than a metal of the donor roll, for example, to reduce wear on the donor roll.

In alternative embodiments, the release agent application apparatus 105 may include a nipped roller pair that includes the donor roll and another roller opposite the donor roll forming a nip through which the substrate 107 may pass. As discussed above, the release agent may be metered to the donor roll surface and applied to the substrate 107 while the substrate 107 is wrapped around the donor roll, but it should be noted that in one or more embodiments, the release agent may be metered to both the donor roll and the another roller to apply release agent to multiple sides of the substrate 107.

According to various embodiments, the thermal state of donor roll, or the nipped roller pair for example, need not be any hotter than the ambient surroundings. Accordingly, there is no need for either roll to be thermally controlled. The pressure applied to the substrate 107 only needs to be sufficient enough to enable spreading of the release agent to the substrate 107. But, in other embodiments, any of the rolls in the release agent application apparatus 105 may be heated to enhance a flow rate or spreading of the release agent or cleaning the rollers, and/or the metering unit may be configured to heat the release agent to aid in enhancing the flow rate of or spreading of the release agent, or cleaning, for example.

For example, in one embodiment, the pressure caused by tensioning the substrate 107 around the donor roll may be fixed or variable. The pressure may be in a range of 0.1 psi to 1500 psi. In another embodiment, the pressure may be in a range of 100 psi to 1000 psi. In another embodiment, the pressure may be in a range of 200 psi to 500 psi. The pressure applied may be controlled to be any of the amount within the ranges discussed above, or simply controlled to apply a pressure within a selected or predetermined range, and may be limited to one or more selected portions or an entire surface side of the substrate.

According to various embodiments, the release agent application apparatus 105 may be controlled by any means such as by way of integrated switches and/or user interface. Alternatively, or in addition to such controls, any number of release agent application apparatuses 105 may be configured to be controlled by way of a central control unit that is remote from any of the release agent application apparatuses 105 and communicates with one or more of the release agent application apparatuses 105 by any means such as a wired or wireless network, for example. Such control and communication, whether onboard or remote from any number of release agent application apparatuses 105, may be facilitated and/or caused by way of a chipset such as that discussed below in FIG. 8.

Figure 2:
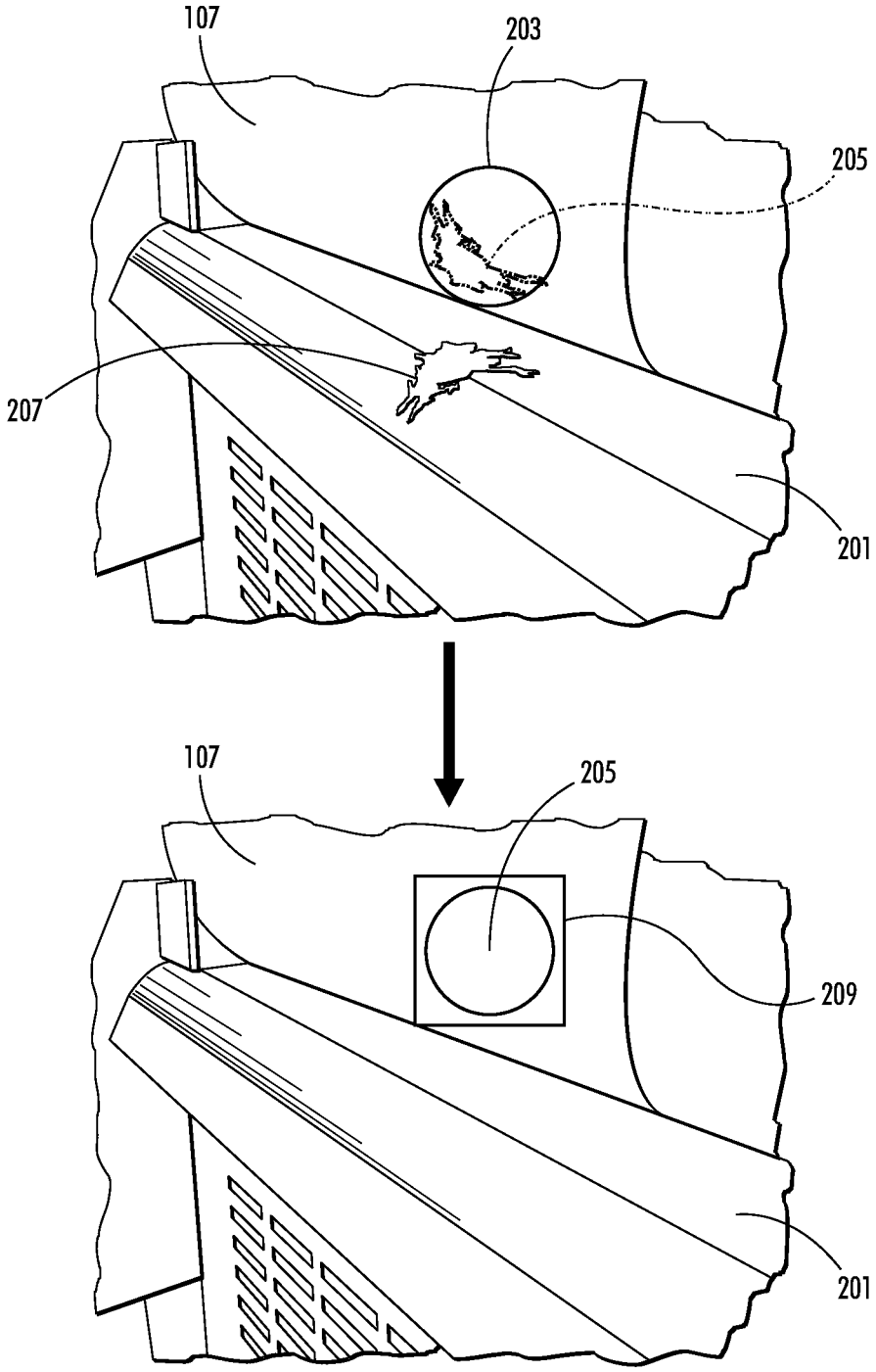
FIG. 2 is a diagram illustrating ink offset, according to one embodiment.

FIG. 2 is a diagram of a comparison of a piece of finishing equipment 201 having a substrate 107 run through it for finishing processing being coated with a sufficient amount of release agent and one not so coated. The substrate 107 has an image 203 printed on one side of the substrate 107. The printed substrate 107 is not coated with any release agent, or is coated with an insufficient amount of release agent, for example, less than 2 mg/A4 paper size, and a portion of the image 205 is left as ink offset 207 on the finishing equipment 201. The ink offset 207 not only causes a mess that requires cleaning and/or potential damage to the finishing equipment, but may also cause image related defects to the image 203. For example, a portion of the image 205 may be lost to the finishing equipment 201 so that the image 203 looks either incomplete, or has an unwanted finish, for example. Additionally, ink offset 207 may be transferred to other substrate 107 portions that pass through the finishing equipment 201. If the ink offset 207 is transferred, it may ruin an image 203 that is printed on a subsequent substrate 107 by causing streaking, ruining a printed finish of the image 203 and/or just covering the image 203 with unwanted ink, for example. Further, ink offset 207 may also be transferred to other portions of the finishing equipment 201 by subsequent substrate 107 portions as it is dragged through the finishing equipment 201.

But, when release agent 209 is applied by the release agent application apparatus 105 discussed above to cover at least the determined portion of the substrate 107 having the image 203, for example at the amounts discussed above such as, but not limited to 7-8 mg/A4 size paper, there is no evidence over long runs of printed product of ink offset 207 to the finishing equipment 201.

Figure 3:
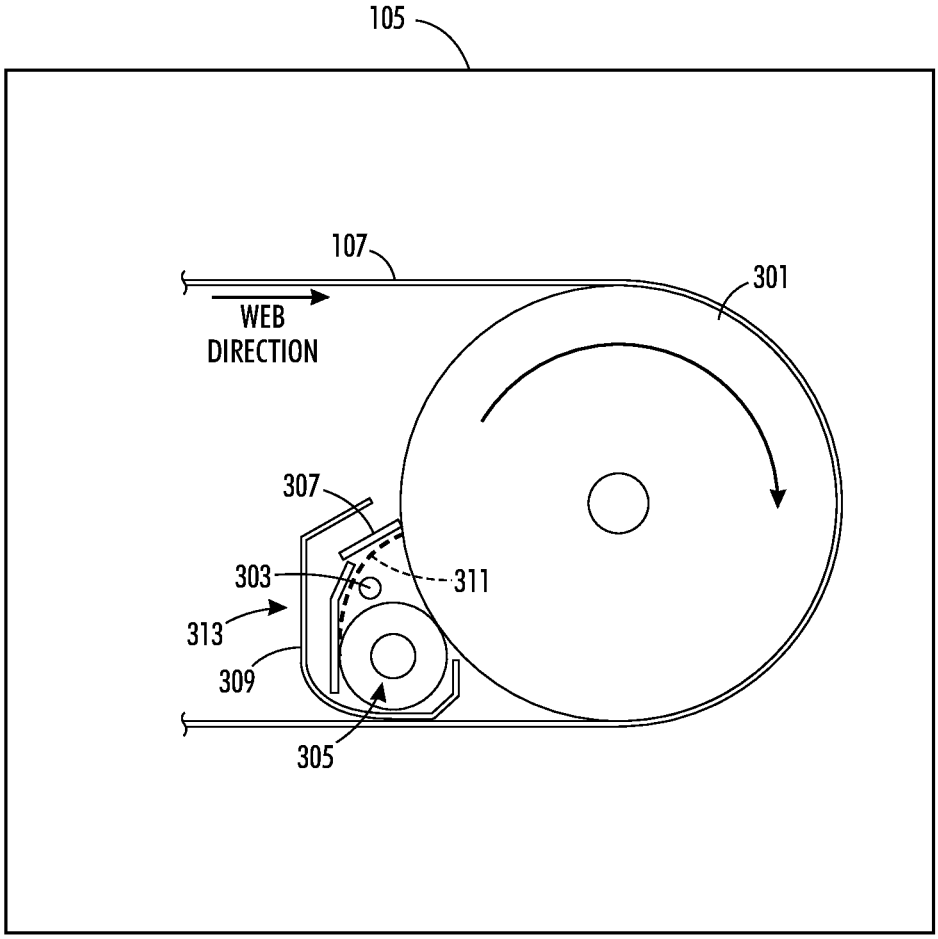
FIG. 3 is a diagram of a release agent application apparatus, according to one embodiment.

FIG. 3 is a diagram of the release agent application apparatus 105, according to one embodiment. As shown, the release agent application apparatus 105 has a donor roll 301, a release agent supply device 303, a release agent applicator 305, and a release agent metering device 307.

In one or more embodiments, the donor roll 301 receives release agent from the release agent applicator 305. For example, the release agent applicator 305 may be a foam roll, hard roll, or a series of spray nozzles or jets that has release agent supplied to it from the release agent supply device 303. The release agent supply device 303 may be any of a drip tube that has one or more holes across its length, or a series of one or more sprayers or jets that supply release agent to the release agent applicator 305, or simply a feeding tube depending on the type of release agent applicator 305.

In one or more embodiments, the release agent metering device 307 may be a blade, as discussed above, or any other means for controlling an amount of release agent that is to be applied to the substrate 107. If the metering device 307 is a blade, for example, the metering device 307 may be adjusted or preset to cause an amount of release agent applied to the donor roll 301 to remain on the donor roll 301 for application to the substrate 107, and any remained release agent to be redirected to a drip tray 309 along path 311. The drip tray 309 may deflect release agent onto the release agent applicator 305, for example, or may allow release agent to accumulate so that it may be used to source the release agent applicator 305, for example.

In one or more embodiments, the release agent supply device 303, release agent applicator 305 and release agent metering device 307 may be embodied together as a release agent supply unit 313. The release agent supply unit 313 may be positioned anywhere so that it may apply release agent to the donor roll 301. The release agent supply unit 313 may, for example, be positioned in such a way that the drip tray 309 is located below the release agent metering device so that excess release agent may be gravity fed to the drip tray 309. However, the release agent supply unit 313 may be positioned anywhere regardless of whether a gravity driven excess release agent path is created.

According to various embodiments, the substrate 107 is fed into the release agent application apparatus 105 and is wrapped under tension around the donor roll 301. In this example, the substrate 107 is in contact with the donor roll 301 for about 180° of its circumference. The contact between the substrate 107 and the donor roll 301 allows for sufficient application and spreading of the release agent onto the surface of substrate 107 that is in contact with the donor roll 301. The tensioning of the substrate 107 causes a pressure to be exerted between the substrate 107 and the donor roll 301 for applying the release agent from the donor roll 301 to the substrate 107. While illustrated as being in contact with the donor roll 301 for about 180°, the substrate 107 may be in contact with the donor roll 301 for any amount of its circumference which may be varied based on a speed of advancement of the substrate 107 through the release agent application apparatus 105, desired direction of feed of the substrate 107 following application of release agent, and the magnitude of the circumference of the donor roll 301, for example. In this embodiment, the contact with the donor roll 301 for 180° allows for a 180° change of direction of movement of the substrate 107, for example.

As discussed above, the donor roll 301 may be any of an aluminum drum coated w/an anodize (e.g. "Hardcoat" or "Hardlube") intended to deliver desired surface roughness and durability, ceramic, other metal, plastic, carbon fiber, etc. Alternatively, the donor roll 301 may be replaced by a belt that is configured to apply release agent to the substrate 107 in the same manner as the example donor roll.

In on or more embodiments, as discussed above, metering device 307 may be constructed of any type of steel core coated w/polyurethane rubber or any other coating of any material of a given thickness (e.g. 2 mm, 7 mm in free length, for example), or any solid polymer, polyurethane, composite, other metal that is softer than a metal of the donor roll 301, carbon fiber, or any material or combination of materials such that wear of the donor roll 301 may be reduced.

Figure 4:
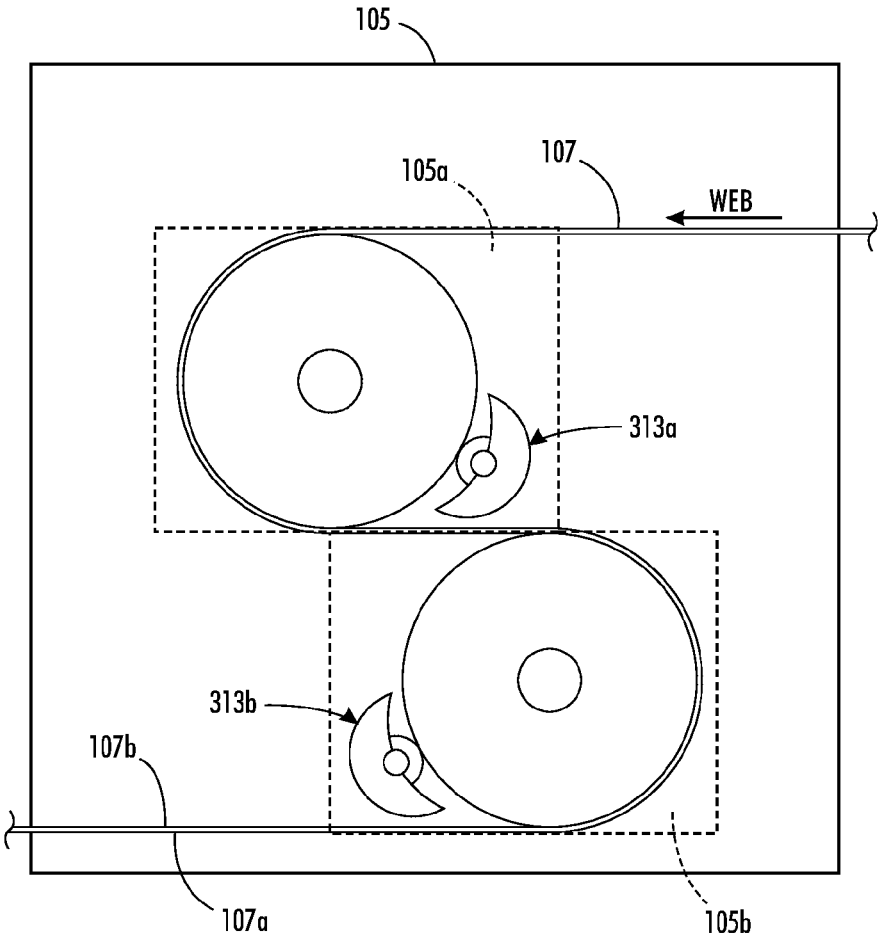
FIG. 4 is a diagram of a release agent application apparatus configured for duplex printing, according to one embodiment.

FIG. 4 is a diagram of an example configuration of a release agent application apparatus 105 having sub-release agent application apparatuses 105*a* and 105*b* to accommodate a duplex printed substrate 107. In this example, the sub-release agent application apparatuses 105*a*/105*b* may not be configured to individually apply application agent to more than one side of the substrate 107. Accordingly, in order to be able to apply release agent to both a first side and a second side of the substrate, a single side release agent application apparatus 105*a* is placed in-line with another inverted single side release agent application apparatus 105*b*. This arrangement may be internal to an overall application apparatus 105 that comprises both the sub-release agent application apparatus 105*a* and sub-release agent application apparatus 105*b*, or by two separate release agent application apparatuses 105 that are predisposed to apply release agent to a specific side of the substrate 107.

For example, sub-release agent application apparatus 105*a* is configured to apply release agent to surface 107*a* of the substrate 107 while sub-release agent application apparatus 105*b* is configured to apply release agent to surface 107*b* of substrate 107.

As illustrated, each of the sub-release agent application apparatuses 105*a* and 105*b* have respective release agent supply units 313*a* and 313*b*. As discussed above, the release agent supply unit 313 may be positioned anywhere so that it may apply release agent to the donor roll 301. Accordingly, the release agent supply units 313*a* and 313*b* may be positioned in the same manner as discussed above.

In this example, the sub-release agent application apparatuses 105*a* and 105*b* are positioned such that both surfaces 107*a*/107*b* of the substrate 107 are coated with release agent and the substrate 107 is cause to enter and exit the release agent application apparatus 105 in a same direction. However, the sub-release agent application apparatuses 105*a* and 105*b* may be arranged such that the direction of movement of the substrate 107 is changed to any direction that may be helpful in applying release agent and/or processing the substrate 107.

One advantage to having the sub-release agent application apparatuses 105*a*/105*b* stacked above one another as illustrated is that such an arrangement saves footprint space that may be limited in a printing facility, for example.

In one or more alternative embodiments, one of the sub-release agent application apparatuses 105*a* or 105*b* may be replaced by a hard donor roll or a conformable donor roll such that the replacement roll forms a nipped roller pair with the donor roll of the remaining sub-release agent apparatus. The nipped roller pair, accordingly, enables application of release agent to either of the surface 107*a* or the surface 107*b* to which the remaining sub-release agent application apparatus does not apply release agent.

Figure 5:
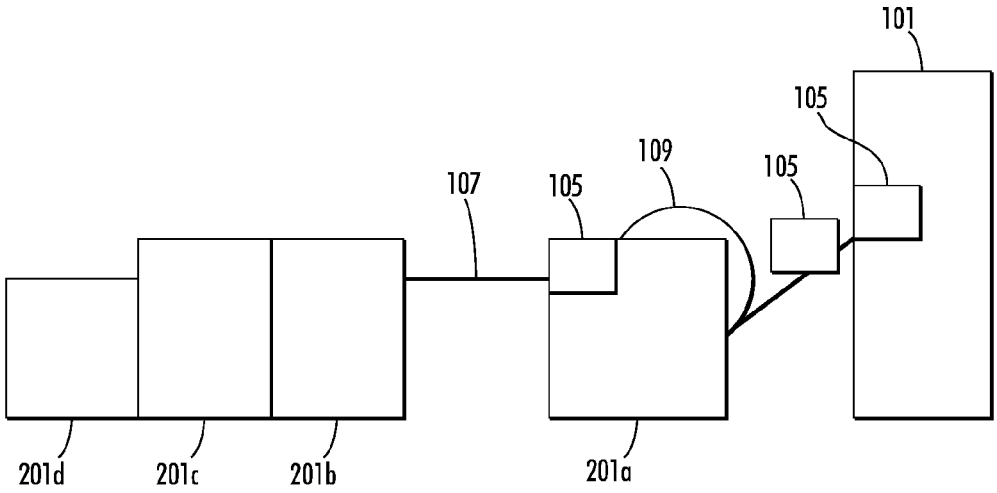
FIG. 5 is a diagram of downstream finishing equipment and placement of one or more release agent application apparatuses, according to one embodiment.

FIG. 5 is a diagram of optional placement of the release agent application apparatus 105. Any number of release agent apparatuses 105 may be placed at any position along a print product manufacturing process. For example, the release agent application apparatus 105 may be mounted directly to the print system 101, be positioned as a standalone release agent application apparatus 105 between the print system 101 and a winder and/or unwinder illustrated as 201*a* that may be part of the print system 101 or may be one or more separate pieces of finishing equipment 201, mounted directly to a winder/unwinder 201*a*, or as a standalone release agent application apparatus 105 between the winder/unwinder 201*a* and another other piece of finishing equipment 201*b*, 201*c*, 201*d*, for example. For this example, finishing equipment 201*b* is a buffer, 201*c* is a cutter, and 201*d* is a stacker. It should be noted that while the finishing equipment 201*a*, 201*b*, 201*c* and 201*d* are illustrated, any number of pieces of finishing equipment 201 may be available to be used and/or protected during a print product manufacturing process.

The winder/unwinder 201*a*, though illustrated as a single entity, may be a single entity, or it may be two separate pieces of finishing equipment 201 and may, for example be operated at separate times if the roll 109 is removed and stored for some time before finishing when then the roll 109 is to be unwound by the unwinder 201*a*. If mounted to the winder/unwinder 201*a*, the release agent application apparatus 105 may be mounted at a position such that it is before the substrate comes in contact with any surfaces of the winder/unwinder 201, for example to protect surfaces of the winder/unwinder 201*a*. Alternatively, or in addition to such placement, the release agent application apparatus 105 may be mounted to an output end of the unwinder 201*a*, for example, to apply release agent before the substrate 107 is fed to any other finishing equipment 201*b*, 201*c*, and 201*d* downstream of the winder/unwinder 201*a* in the print product manufacturing process, for example.

Alternatively, the print system 101 may be configured to accommodate sheets of substrate 107, or cut the a rolled substrate 107 into sheets to that the substrate 107 is stacked at an output side of the print system 101. Accordingly, the winder/unwinder 201*a* may be replaced by a stacker which may also be fitted accordingly with a release agent application apparatus 105.

Figure 6:
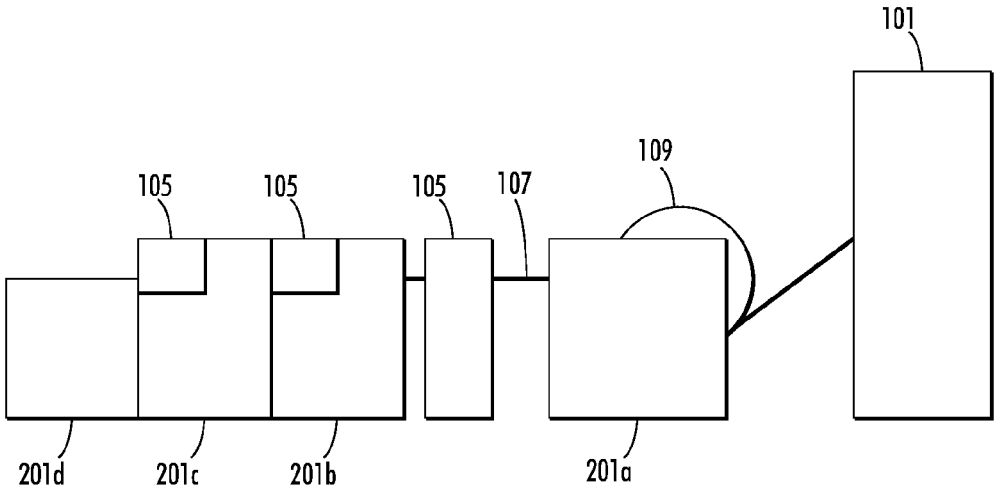
FIG. 6 is a diagram of downstream finishing equipment and placement of one or more release agent application apparatuses, according to one embodiment.

FIG. 6 is a diagram of other alternative placement of one or more release agent application apparatuses 105. As discussed above, the release agent application apparatus 105 may take many forms such as a standalone apparatus and may, in some embodiments, be adaptable to be retrofitted to any piece of finishing equipment 201. If, for example, the winder/unwinder 201*a* is such that mounting the release agent application apparatus 105 is prohibitive from an integration or cost standpoint, one or more release agent application apparatuses 105 may be mounted to any of the other finishing equipment 201*b*, 201*c*, and 201*d*, or positioned as a standalone apparatus after the winder/unwinder 201*a* but before, or between, any of the other finishing equipment 201 which may or may not be connected in-line as illustrated and may have spacing and/or timing between operations between them. This configuration, however, does not protect the winder/unwinder 201*a* components from risk of ink offset. Both concepts are however far better than doing nothing to mitigate ink offset for off-line finishing. For this example, finishing equipment 201*b* is a buffer, 201*c* is a cutter, and 201*d* is a stacker. It should be noted that while the finishing equipment 201*a*, 201*b*, 201*c* and 201*d* are illustrated, any number of pieces of finishing equipment 201 may be available to be user and/or protected during a print product manufacturing process.

Figure 7:
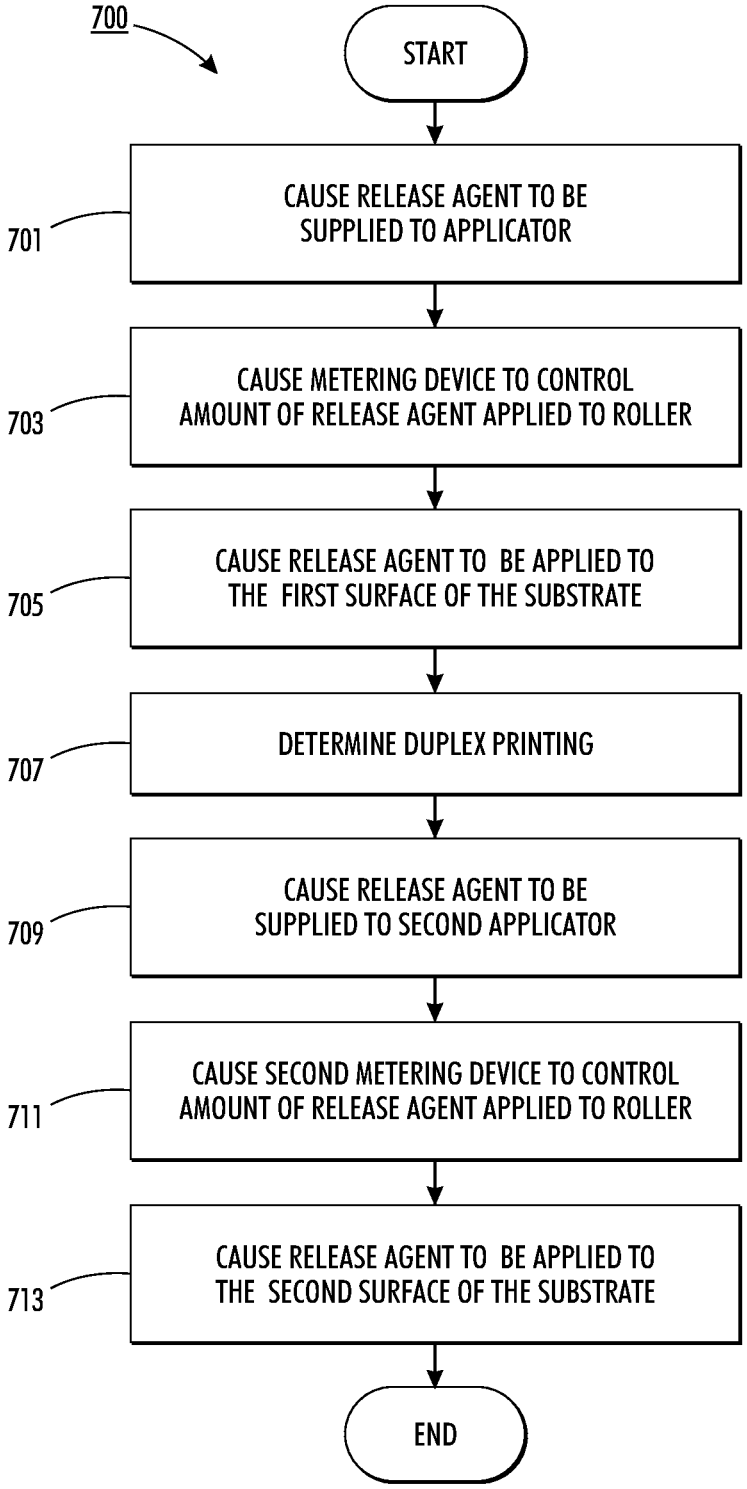
FIG. 7 is a flowchart of a process for applying a release agent to a substrate to prevent ink offset from the substrate to one or more portions of print processing and/or finishing equipment, according to one embodiment.
Figure 8:
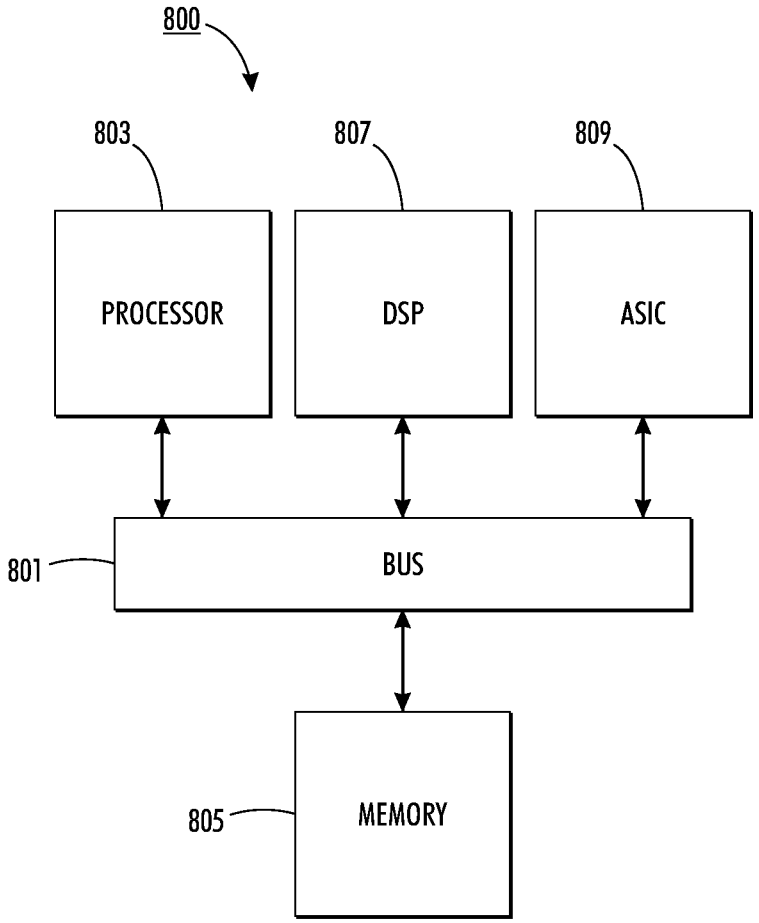
FIG. 8 is a diagram of a chip set that can be used to implement an embodiment.

FIG. 7 is a flowchart of a process for applying a release agent to a substrate to prevent ink offset from the substrate to one or more portions of print processing and/or finishing equipment, according to one embodiment. In one embodiment, the release agent application apparatus 105 is caused to perform the process 700 by way of computer readable code implemented in, for instance, a chip set including a processor and a memory as shown in FIG. 8.

In step 701, a substrate 107 discussed above having a first surface 107*a* and a second surface 107*b* is provided and a release agent supply device such as release agent supply device 303 is caused to supply release agent to release agent applicator 305, discussed above. Then, in step 703, the release agent metering device 307 is caused to control an amount of release agent applied to donor roll 301 that is configured to apply release agent to the first surface 107*a* of the substrate 107. The donor roll 301, as discussed above, is a roller that is configured to accommodate the substrate 107 under a tension over at least a portion of a circumference of the roller such that a pressure is exerted between the roller and the first surface 107*a* of the substrate 107*b*.

The process continues to step 705 in which release agent is caused to be applied to the first surface 107*a* of the substrate 107 by the donor roll 301. Then, in step 707, the release agent application apparatus 105 may determine that the substrate 107 is subjected to a duplex printing process. Accordingly, the process continues to step 709 in which a second release agent supply device is caused to supply another amount of release agent to a second release agent applicator. Then, in step 711, the a second release agent metering device is caused to control a second amount of release agent applied to a second donor roll that is configured to apply the second amount of release agent to the first surface 107*a* of the substrate 107. The second amount of release agent may be the same or different as that which is applied to the first surface of the substrate discussed above. The second donor roll, as discussed above, is a roller that is configured to accommodate the substrate 107 under another tension which may or may not be the same as the tension that donor roll 301 accommodates the substrate 107, over at least a portion of a circumference of the second roller such that a second pressure is exerted between the second roller and the second surface 107*b* of the substrate.

Then, in step 713, release agent is caused to be applied to the second surface 107*b* of the substrate 107 by the second donor roll.

The second release agent supply device, second release agent applicator, second release agent metering device, and second roller may, for example, all be the same or similar variations of release agent supply device 303, release agent applicator 305, release agent metering device 307 and donor roll 301, embodied as sub-release agent application apparatus 105*b*, for example, as discussed above.

The processes described herein for applying a release agent to a substrate to prevent ink offset from the substrate to one or more portions of print processing and/or finishing equipment may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 8 illustrates a chip set or chip 800 upon which an embodiment may be implemented. Chip set 800 is programmed to apply a release agent to a substrate to prevent ink offset from the substrate to one or more portions of print processing and/or finishing equipment as described herein may include, for example, bus 801, processor 803, memory 805, DSP 807 and ASIC 809 components.

The processor 803 and memory 805 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 800 can be implemented in a single chip. It is further contemplated that in certain embodiments the chip set or chip 800 can be implemented as a single "system on a chip." It is further contemplated that in certain embodiments a separate ASIC would not be used, for example, and that all relevant functions as disclosed herein would be performed by a processor or processors. Chip set or chip 800, or a portion thereof, constitutes a means for performing one or more steps of applying a release agent to a substrate to prevent ink offset from the substrate to one or more portions of print processing and/or finishing equipment.

In one or more embodiments, the chip set or chip 800 includes a communication mechanism such as bus 801 for passing information among the components of the chip set 800. Processor 803 has connectivity to the bus 801 to execute instructions and process information stored in, for example, a memory 805. The processor 803 may include one or more processing cores with each core configured to perform independently. A multi-core processor enables multiprocessing within a single physical package. Examples of a multi-core processor include two, four, eight, or greater numbers of processing cores. Alternatively or in addition, the processor 803 may include one or more microprocessors configured in tandem via the bus 801 to enable independent execution of instructions, pipelining, and multithreading. The processor 803 may also be accompanied with one or more specialized components to perform certain processing functions and tasks such as one or more digital signal processors (DSP) 807, or one or more application-specific integrated circuits (ASIC) 809. A DSP 807 typically is configured to process real-world signals (e.g., sound) in real time independently of the processor 803. Similarly, an ASIC 809 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 803 performs a set of operations on information as specified by computer program code related to applying a release agent to a substrate to prevent ink offset from the substrate to one or more portions of print processing and/or finishing equipment. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 801 and placing information on the bus 801. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 803, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 803 and accompanying components have connectivity to the memory 805 via the bus 801. The memory 805 may include one or more of dynamic memory (e.g., RAM, magnetic disk, writable optical disk, etc.) and static memory (e.g., ROM, CD-ROM, etc.) for storing executable instructions that when executed perform the inventive steps described herein to apply a release agent to a substrate to prevent ink offset from the substrate to one or more portions of print processing and/or finishing equipment. The memory 805 also stores the data associated with or generated by the execution of the inventive steps.

In one or more embodiments, the memory 805, such as a random access memory (RAM) or any other dynamic storage device, stores information including processor instructions for applying a release agent to a substrate to prevent ink offset from the substrate to one or more portions of print processing and/or finishing equipment. Dynamic memory allows information stored therein to be changed by system 100. RAM allows a unit of information stored at a location called a memory address to be stored and retrieved independently of information at neighboring addresses. The memory 805 is also used by the processor 803 to store temporary values during execution of processor instructions. The memory 805 may also be a read only memory (ROM) or any other static storage device coupled to the bus 801 for storing static information, including instructions, that is not changed by the system 100. Some memory is composed of volatile storage that loses the information stored thereon when power is lost. The memory 805 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 803, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. An apparatus useful in printing, comprising:

a donor roll to advance a substrate and to cause release agent application onto a first surface of the substrate, wherein the substrate has a first surface and a second surface;

a release agent applicator to apply release agent to the donor roll;

a release agent supply device including a plurality of holes, wherein each hole is adapted to dispense by dripping a release agent on the release agent applicator;

a release agent metering device configured to control an amount of release agent to be applied to the substrate, wherein the metering device may be adjusted or preset to cause an amount of release agent applied to the donor roll to remain on the donor roll for application to the substrate;

a drip tray located below the release agent metering device so that excess release agent from the donor roll may be gravity fed to the drip tray;

wherein the donor roll is configured to accommodate the substrate under a tension over at least a portion of a circumference of the donor roll such that a pressure is exerted between the donor roll and the first surface of the substrate;

wherein the release agent supply device is a drip tube configured to supply the release agent applicator with release agent to be applied to the first surface of the substrate by way of plurality of holes along a length of the drip tube;

wherein the release agent supply device and the release agent applicator are configured to apply release agent an entirety of the first surface of the substrate that corresponds to one or more determined locations of one or more images applied to the substrate.

2. An apparatus of claim 1, wherein the drip tube comprises one or more of a copper, polymer, aluminum, and stainless steel.

3. An apparatus of claim 1, wherein the release agent supply device comprises at least one spray nozzle configured to supply the release agent applicator with release agent to be applied to the first surface of the substrate.

4. An apparatus of claim 1, wherein the release agent supply device and the release agent applicator are configured to selectively apply release agent to one or more portions of the first surface of the substrate that correspond to one or more determined locations of one or more images applied to the first surface of the substrate.

5. An apparatus of claim 2, wherein the release agent metering device is a blade configured to spread release agent evenly on the donor roll.

6. An apparatus of claim 1, wherein the release agent applicator comprises one or more rollers.

7. An apparatus of claim 1, wherein the release agent applicator comprises one or more release agent jets.

8. An apparatus of claim 1, wherein the substrate is subjected to a duplex printing process, and the release agent is applied to the first surface and the second surface of the substrate.

9. An apparatus of claim 8, further comprising:

a second release agent supply device configured to supply release agent to a second release agent applicator;

a second release agent metering device configured to control a second amount of release agent applied to a second donor roll configured to apply release agent to the second surface of the substrate, wherein the second the donor roll is configured to accommodate the substrate under another tension over at least a portion of a circumference of the second the donor roll such that another pressure is exerted between the second the donor roll and the second surface of the substrate;

a second drip tray located below the second release agent metering device so that excess release agent may be gravity fed to the second drip tray.

10. An apparatus of claim 9, wherein the second the donor roll is configured to form a release agent application nip to apply release agent to the second surface of the substrate.

11. An apparatus of claim 1 wherein the release agent is applied at a rate of 2 mg/A4 paper size to 12 mg/A4 paper size.

12. An apparatus of claim 1, wherein the release agent comprises an oil, and the release agent has a kinematic viscosity of 50 cS to 100 cS.

13. An apparatus of claim 1, wherein the donor roll comprises one or more of aluminum, polymer, and stainless steel.

14. An apparatus of claim 1, wherein the release agent supply device, release agent applicator, and release agent metering device are embodied in a unit configured to be mounted.

15. An apparatus of claim 1, wherein the release agent supply device, release agent applicator, and release agent metering device are embodied in a portable unit configured to stand alone.

16. An apparatus of claim 1, wherein the release agent metering device is a blade configured to spread release agent evenly on the donor roll.

17. A method for applying a release agent to a substrate having a first surface and a second surface, the method comprising:

advancing a substrate with a donor roll to cause release agent application onto the first surface of the substrate;

applying release agent to the donor roll with a release agent applicator;

causing, at least in part, a release agent supply device to supply by dripping a release agent to the release agent applicator; and controlling an amount of release agent to be applied to the substrate through a release agent metering device, wherein the metering device may be adjusted or preset to cause an amount of release agent applied to the donor roll to remain on the donor roll;

locating, at least in part, a drip tray below the release agent metering device so that excess release agent from the donor roll may be gravity fed to the drip tray;

wherein the donor roll is configured to accommodate the substrate under a tension over at least a portion of a circumference of the donor roll such that a pressure is exerted between the donor roll and the first surface of the substrate;

wherein the release agent supply device is a drip tube configured to supply the release agent applicator with release agent to be applied to the first surface of the substrate by way of one or more holes populated along a length of the drip tube;

wherein the release agent supply device and the release agent applicator are configured to apply release agent an entirety of the first surface of the substrate that corresponds to one or more determined locations of one or more images applied to the substrate.

18. A method of claim 17, wherein the substrate is subjected to a duplex printing process, the method further comprising:

causing, at least in part, the release agent to be applied to the first surface and the second surface of the substrate;

causing, at least in part, a second release agent supply device to supply by dripping a release agent to a second release agent applicator; and causing, at least in part, a second release agent metering device to control a second amount of release agent applied to a second donor roll configured to apply release agent to the second surface of the substrate, wherein the second donor roll is configured to accommodate the substrate under another tension over at least a portion of a circumference of the second donor roll such that another pressure is exerted between the second donor roll and the second surface of the substrate.

* * * * *